US006886700B2

(12) United States Patent
Nagel

(10) Patent No.: US 6,886,700 B2
(45) Date of Patent: May 3, 2005

(54) ADJUSTABLE PRODUCT DISPLAY RACK WITH EXTENSION PANEL

(75) Inventor: Thomas O. Nagel, Blairstown, NJ (US)

(73) Assignee: Trion Industries, Inc., Wilkes-Barre, PA (US)

( * ) Notice: Subject to any disclaimer, the term of this patent is extended or adjusted under 35 U.S.C. 154(b) by 60 days.

(21) Appl. No.: 10/384,255

(22) Filed: Mar. 7, 2003

(65) Prior Publication Data

US 2004/0173546 A1 Sep. 9, 2004

(51) Int. Cl.[7] ..... A47F 5/00
(52) U.S. Cl. ..... 211/59.3; 211/184
(58) Field of Search ..... 211/59.3, 51, 181.1, 211/184, 74, 175, 59.2; 312/61, 71

(56) References Cited

U.S. PATENT DOCUMENTS

| | | | | | |
|---|---|---|---|---|---|
| 1,703,987 | A | | 3/1929 | Butler | |
| 2,079,754 | A | | 5/1937 | Waxgiser | |
| 2,111,496 | A | * | 3/1938 | Scriba | 211/59.3 |
| 2,732,952 | A | * | 1/1956 | Skelton | 211/59.3 |
| 3,110,402 | A | * | 11/1963 | Mogulescu | 211/59.3 |
| 4,899,893 | A | * | 2/1990 | Robertson | 211/59.3 |
| 5,390,802 | A | * | 2/1995 | Pappagallo et al. | 211/59.3 |
| 5,413,229 | A | * | 5/1995 | Zuberbuhler et al. | 211/59.3 |
| 5,562,217 | A | * | 10/1996 | Salveson et al. | 211/59.3 |
| 5,634,564 | A | * | 6/1997 | Spamer et al. | 211/59.3 |
| 5,685,664 | A | * | 11/1997 | Parham et al. | 403/393 |
| 5,730,320 | A | * | 3/1998 | David | 221/279 |
| 6,015,051 | A | * | 1/2000 | Battaglia | 211/59.3 |
| 6,105,791 | A | * | 8/2000 | Chalson et al. | 211/59.3 |
| 6,142,317 | A | * | 11/2000 | Merl | 211/59.3 |
| 6,357,606 | B1 | * | 3/2002 | Henry | 211/59.3 |
| 6,409,027 | B1 | * | 6/2002 | Chang et al. | 211/59.3 |
| 6,484,891 | B2 | * | 11/2002 | Burke | 211/59.3 |
| 6,655,536 | B2 | * | 12/2003 | Jo et al. | 211/59.3 |
| 2001/0035383 | A1 | * | 11/2001 | Burke | 211/59.3 |
| 2003/0010732 | A1 | * | 1/2003 | Burke | 211/59.3 |

* cited by examiner

*Primary Examiner*—Carl D. Friedman
*Assistant Examiner*—Jennifer E. Novosad
(74) *Attorney, Agent, or Firm*—Schweitzer Cornman Gross & Bondell LLP

(57) ABSTRACT

A display rack assembly for the display of product packages, with provisions for pushing packages toward the front of the display as individual packages are removed. The assembly includes a support base for supporting the packages and slidably mounting a spring-urged pusher. The pusher has front and back panels, with the back panel being joined along its upper edge to the back of the front panel, and the respective bottom edges being spaced apart in the front to back direction. A generally flat, front extension panel is removably attached to the front pusher panel to extend its dimensions upwardly or laterally, or both. This enables a standardized display rack to be easily adapted for tall and/or wide packages, as well as packages of smaller sizes. Interchangeable extension panels also can be provided with product advertising, specific to the product being displayed, which can be replaced or interchanged when a new product is displayed.

18 Claims, 3 Drawing Sheets

ADJUSTABLE PRODUCT DISPLAY RACK WITH EXTENSION PANEL

RELATED APPLICATIONS

This application is related to U.S. applications Ser. No. 10/219,800, filed Aug. 16, 2002 (now U.S. Pat. No. 6,745,906), Ser. No. 10/232,509, filed Aug. 30, 2002, and 10/323,461, filed Dec. 18, 2002, all of which are owned by Trion Industries, Inc., the owner of this application.

BACKGROUND OF THE INVENTION

Product display and shelf management frequently requires that a supply of products of the same type, displayed on a shelf or rack, be kept in an orderly, upright arrangement and be constantly urged forwardly, as product items are removed, so that the display is always neat and the product is always visible and available for display at the front of the display device. A variety of devices and systems have been proposed over the years for accomplishing this objective. Some of the more important improvements in such systems are reflected in the above-mentioned related applications.

The above mentioned pending applications are directed to various features of a product display rack comprised preferentially of a wire rack structure supported at front and back ends by special low profile plastic bases. A product pusher is slidably mounted on the wire rack structure, and actuated by a spring which constantly urges the pusher device toward the front of the display rack in order to maintain the product inventory in the front portion of the rack as individual product items are removed by customers.

In many, if not most cases, it is desirable to provide the product display rack with width-adjustable wire side guides, in order to maintain products in an orderly alignment while accommodating changes from time to time in the width of the products displayed on the rack. Such side guides advantageously comprise wire elements extending from front to back at each side, and having transverse mounting sections slidably engaged with the plastic bases at opposite sides of the display rack.

SUMMARY OF INVENTION

For a variety of reasons, and particularly when adjustable side guides are incorporated into the product display rack assembly, the pusher element must have a maximum width corresponding to the minimum adjustable width position of the side guides. Likewise, even in those cases where the display rack is not provided with side guides, it is typically desired to position laterally adjacent racks as close together as practicable, unless the width of the product items requires a greater lateral spacing. For similar reasons, the height of the pusher tends to be determined as a function of the height of the shortest product to be displayed on the rack. These practical physical limitations on the height and width of the pusher can present problems when the product to be displayed is relatively tall and/or wide, particularly if the product is of a flexible nature, for example, packaged clothing items, certain bagged food products, etc.

In accordance with the present invention, a novel adjustable product display system is provided, which incorporates an inexpensive removable/replaceable extension panel, which is inexpensive to produce, easily and conveniently stored, and quickly installed when needed and removed when not needed. Extension panels can be inexpensively provided in various combinations of height and width, enabling a standardized product display rack assembly to be quickly and easily adapted for the handling of variously oversized products.

In a particularly advantageous form of the invention, the product pusher comprises flat, sheet-like front and back panels, joined at the top, in a generally inverted V-shaped configuration. The spaced-apart bottom edges of the pusher are formed with openings for the slidable reception of support wires extending in the front-to-back direction in the track structure, and a pusher spring is contained in the space between the two panels. To advantage, this design of pusher element is formed as a continuous extrusion having the inverted V-shaped configuration, which is cut to the desired width and then notched appropriately along the lower edge portions of the front and back panel sections for engagement with the support wires of the display rack structure. Although it is theoretically possible to provide pusher elements in a variety of heights, as a practical matter the pusher elements are provided in only one or two different heights each intended to handle a wide array of products, in many cases in a less than optimal manner. According to the present invention, however, extension panels can be provided inexpensively in any convenient height and width, and attached to the front panel of the pusher so as to effectively extend the height and/or width of the pusher as necessary or appropriate for the particular merchandise being displayed.

In a particularly advantageous form of the invention, the extension panels are of extruded form and are extruded in the direction of the height of the extension panel. Accordingly, extruded panels may be easily cut to a preset length as part of the extrusion process. Similarly, for the production of extension panels of different width, the extrusion die can be designed for the largest width of a range, and the extruded product trimmed along its lateral edges, or the extrusion die can be temporarily closed off at the edge extremities for the production of narrower extension panels.

As a feature of particular advantage, extension panels may be designed for specific products and provided with advertising exposure on the front surfaces thereof. Thus, when displaying a particular product, a dedicated extension panel may be provided for that product, with a margin exposed above the top of the product bearing advertising or other information relating to that product, and perhaps also containing additional information about the product that will be exposed when the last product item is removed. In cases such as these, even though a new product to be displayed in the rack may not require a change of the size of the extension panel, a new extension panel may be inserted without advertising information or with advertising information relevant to the new product.

In an advantageous alternative form of the invention, an extension panel of the type described above may be provided on its front surface with an opposed pair of vertically extending guide flanges adapted for the vertical reception of a printed card containing advertising material or the like. In this alternative form, instead of providing dedicated extension panels, with advertising or other indicia relating to a particular product printed thereon, the extension panels may be provided in a more generic form, with spaced-apart guide flanges for replaceably receiving cards pre-printed with the desired information. The individual pre-printed cards may be removed and replaced as appropriate to provide a new display message.

For a more complete understanding of the above and other features and advantages of the invention, reference should be made to the following detailed description of a preferred embodiment of the invention, and to the accompanying drawings.

DESCRIPTION OF THE DRAWINGS

FIG. 4 is a fragmentary perspective view, showing a portion of an alternative form of extension panel provided on its front surface with opposed flanges for the reception of pre-printed advertising cards and the like.

DESCRIPTION OF A PREFERRED EMBODIMENTS

Figure 1:
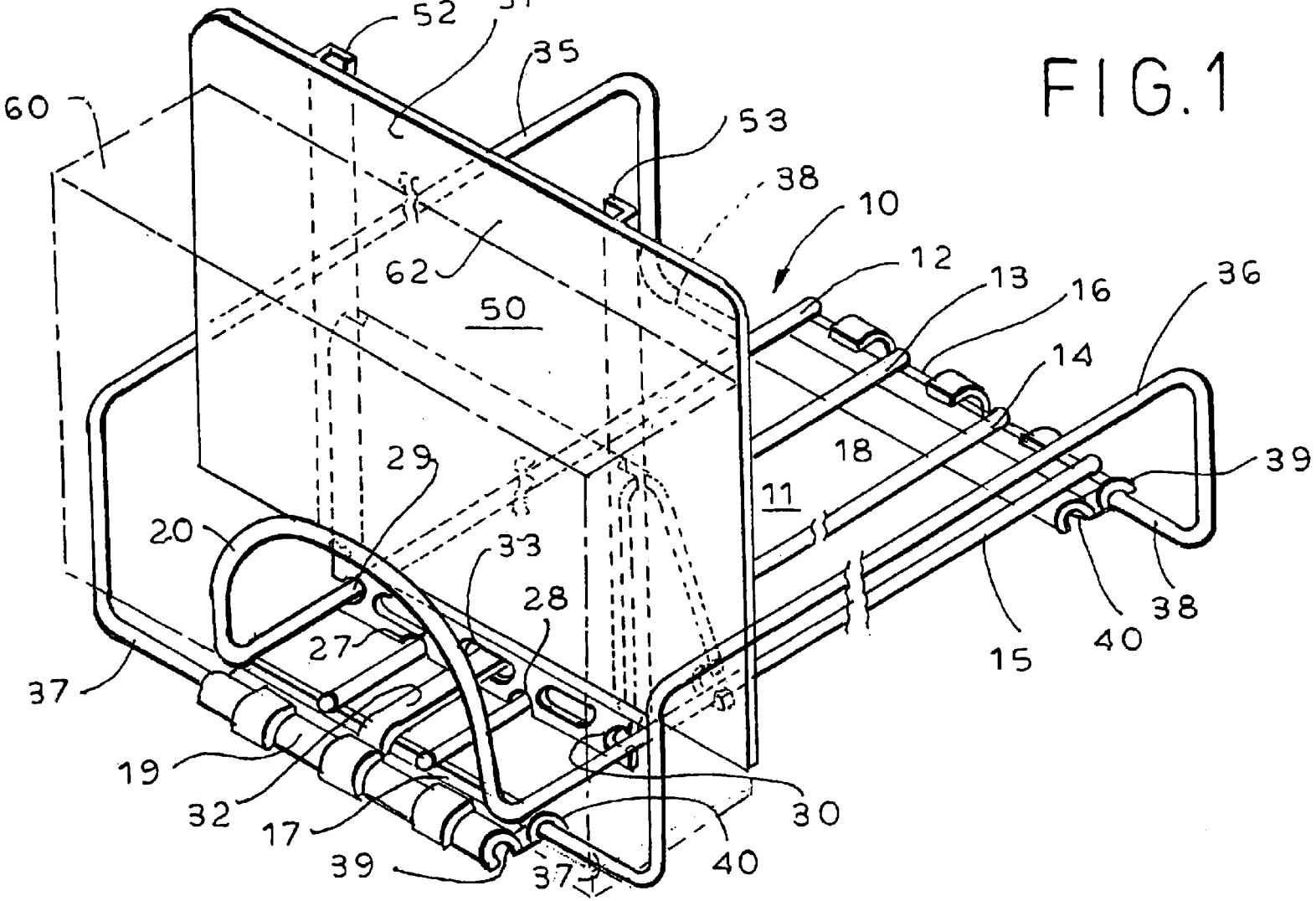
FIG. 1 is a perspective view of an advantageous form of product display rack incorporating the extension panel feature of the invention.

Referring now to the drawing, the reference numeral 10 designates generally a display rack of the type, for example, shown in co-pending application Ser. No. 10/323,461. The display rack includes a support base 11 which preferably comprises four wire support elements 12–15 arranged in a spaced-apart, parallel manner, extending in the front-to-back (longitudinal) direction. The end extremities of the wire supports 12–15 are welded to underlying transverse cross bars 16, 17 to provide a rigid, grid-like support base structure. Molded plastic base elements 18, 19 are formed with upwardly opening grooves (not specifically shown) to receive the respective cross bars 16, 17, preferably with a snap-in assembly action such that, once assembled, the base elements 18, 19 remain firmly attached to the cross bars 16, 17 unless intentionally removed therefrom.

In a preferred form of the invention, the opposite side support elements 12, 15 are integrally joined at the front by a suitably shaped connecting section 20, which extends upward and forms an abutment stop at the front of the display rack.

A product pusher 21 is slidably supported on the longitudinally extending wire elements 12–15. To particular advantage, the pusher element 21 consists of generally flat front and back panels 22, 23 joined along their upper edge extremities at 24 somewhat in the configuration of an inverted "V". Alternatively, the back panel may join the front panel below the upper edge of a flat front panel, in somewhat of an inverted "Y" configuration. The bottom edges 25, 26 of the pusher panels 22, 23 are notched for the reception of the support wire elements 12–15. As described in our before mentioned applications, each of the panels is formed with two downwardly opening notches 27, 28 positioned to be loosely received over the inside wire support elements 13, 14. The opposite side edges of the panels are provided with laterally opening notches 29, 30, preferably with restricted edge openings, arranged to be loosely received over the outer wire elements 12, 15 of the support base, all as shown particularly in FIG. 1. The design and construction of the pusher element 21 is such that it can be installed on the pre-assembled support base 11 by squeezing the front and back panels close together and orienting the panels at a slight angle to the perpendicular relative to the wire elements 12–15. This allows the panel elements to be installed with a twist and lock motion, after which the pusher element is engaged by the wires for free sliding movement in the longitudinal direction while being effectively permanently engaged with the support wires unless intentionally disassembled.

Figure 2:
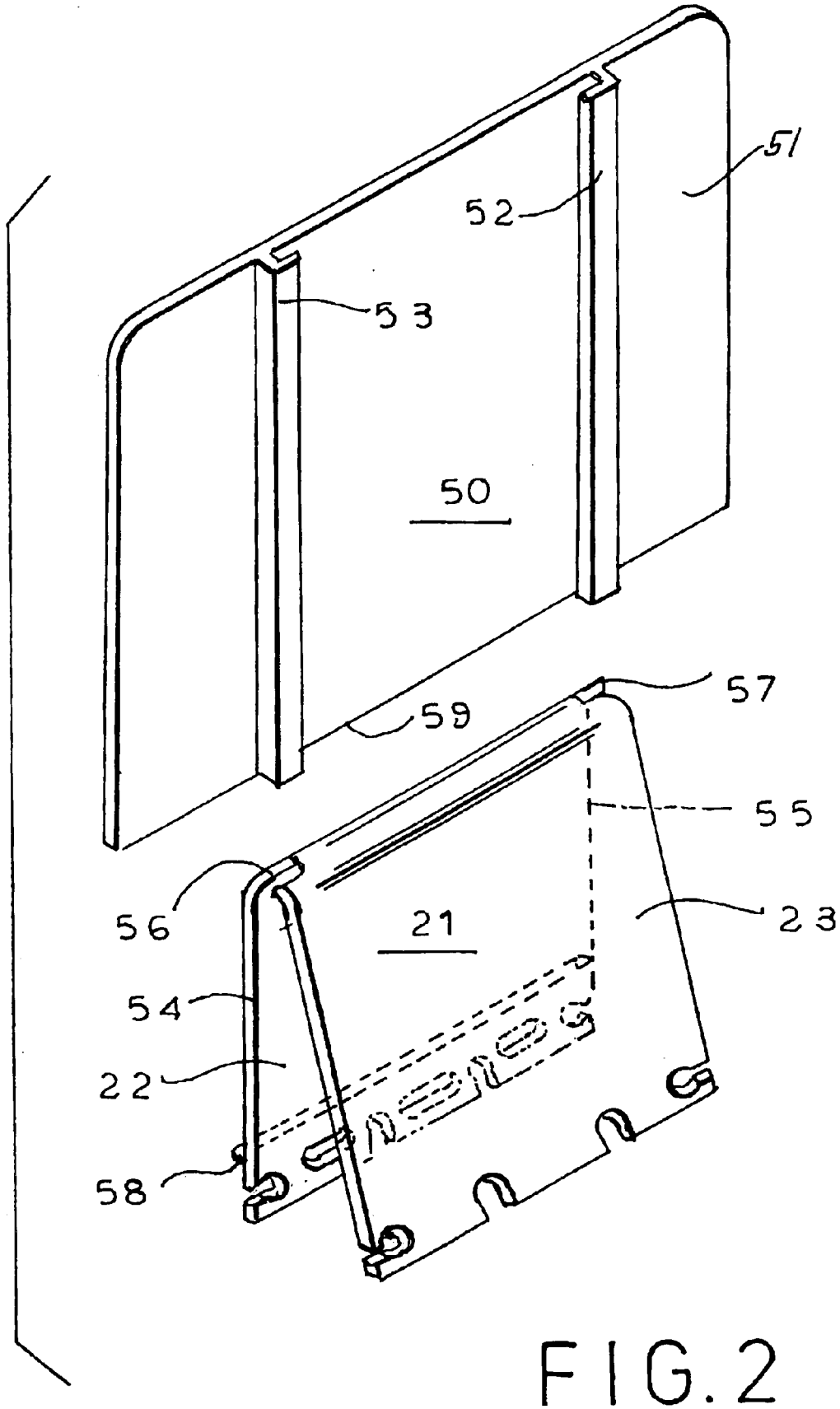
FIG. 2 is an exploded view illustrating a product pusher element incorporated in the display rack of FIG. 1 and the extension panel associated therewith, illustrating the manner of assembly of the extension panel.
Figure 3:
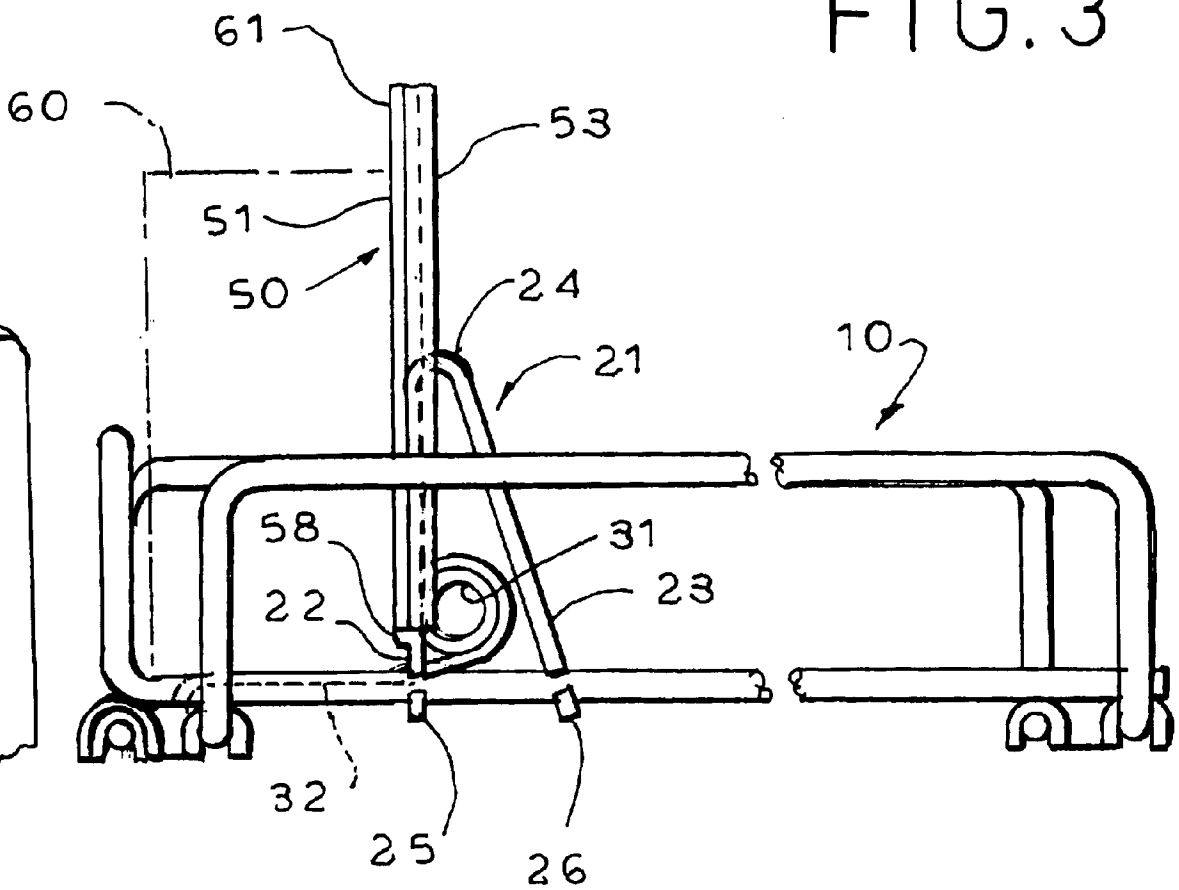
FIG. 3 is a side elevational view of the display rack of FIG. 1.

As shown in FIGS. 1 and 2, a pusher spring 31, in the form of a coiled strip, is positioned between the front and back panels 22, 23 of the pusher. The outer end 32 of the spring extends forwardly through an opening 33 in the front pusher panel and is lockingly engaged in a slot (not shown) provided therefor in the front mounting block 19. The pusher spring serves to constantly urge the pusher 21 toward the front of the display rack 10, as will be well understood.

In accordance with the disclosures of the above mentioned co-pending applications, the display rack 10 advantageously is provided with adjustable side guide elements 35, 36 for the lateral confinement of product items positioned on the support base 11. The side guide elements preferably include transversely extending mounting portions 37, 38 which are snugly but movably received in transverse recesses 39, 40 provided in the plastic base members 18, 19. The mounting members 37, 38 may have a length substantially equal to that of the base members 18, 19. When fully received in their respective recesses 39, 40, the mounting portions 37, 38 support the side guides 35, 36 in positions closely adjacent to the opposite ends of the base members, providing a minimum-width configuration of the display rack. To accommodate products of greater width than the minimum, the side guides may be adjusted outwardly (usually symmetrically). The position of maximum outward width adjustment is that which leaves an adequate length of the mounting portions 37, 38 engaged within the recesses 39, 40 to provide adequate support for the side guides.

As will be understood, the minimum width configuration of the display rack, with the side guides in their innermost positions, fixes the maximum width of the pusher 21. Practical considerations fix the optimum height of the pusher panel, so that it is tall enough to handle a wide variety of product items, yet not so tall as to present an unsightly display with smaller products. This can present problems when displaying large products, and the problems are aggravated when the product items are of a soft or flexible nature. Packaged clothing items, for example, are best displayed in a straight and upright manner, with minimum sagging or drooping. Likewise, such products as snack foods packaged in bags, magazines, etc. are best displayed where the support by the pusher is geometrically suited to the product, from a width and/or height standpoint.

Pursuant to the present invention, the pusher 21 can be provided with an interchangeable extension panel 50, of an inexpensive nature, which can be quickly installed on and/or removed from the pusher 21 in order to optimize the display rack to a particular product being displayed. The extension panel advantageously is in the form of a flat panel 51 of rigid plastic material, preferably formed by extrusion and provided with spaced-apart, vertically extending L-shaped mounting flanges 52, 53 along the back surface of the panel. The mounting flanges define inwardly facing channels of a size and shape to closely receive opposite side edges 54, 55 of the pusher front panel 22.

Where the back panel 23 is of the same width as the front panel 22, which will be true in the majority of cases, the pusher panel is formed with laterally opening notches 56, 57 in the region of the pusher where the back panel 23 joins the front panel 22. The notches receive the inwardly directed portions of the mounting flanges 52, 53, enabling the extension panel 50 to be assembled with the pusher panel 21 by sliding the extension panel downwardly over the front panel 22 of the pusher.

To advantage, the front panel 22 of the pusher is provided with an integrally extruded, forwardly projecting rib 58, positioned slightly above the spring opening 33. The rib 58 engages the bottom edge 59 of the extension panel and forms a limit stop for downward movement of the extension panel.

As will be readily appreciated, the extension panels 50 may be inexpensively produced by continuous extrusion, cut to any height desired and provided in any suitable width by edge trimming during the extrusion process and/or plugging the extremities of the extrusion die. The panels are flat and easily stored, quickly removed and installed, and thus enable the product display rack to be quickly optimized to the characteristics of the particular products being displayed.

An additional advantage of the use of the interchangeable extension panels 50 of the invention is that the panels may be provided with advertising and other information specific to the particular product being displayed and quickly interchangeable whenever a new product is loaded onto the display rack. In the arrangement illustrated in the drawings, for example, the extension panel 50 is shown to have a height slightly greater than the product item 60 being displayed. Accordingly, a margin 61 of the extension panel is exposed above the top of the product 60 and can be provided with product information 62 (FIG. 1) appropriate to the product. Likewise, the unexposed area of the extension panel, below the top edge of the package 60 can be provided with different advertising or other information which becomes exposed when the last product package is removed from the display. The inexpensive nature of the extension panels enables them to be economically made product specific, and even time specific, to be discarded after a special sale or promotion, for example.

Figure 4:
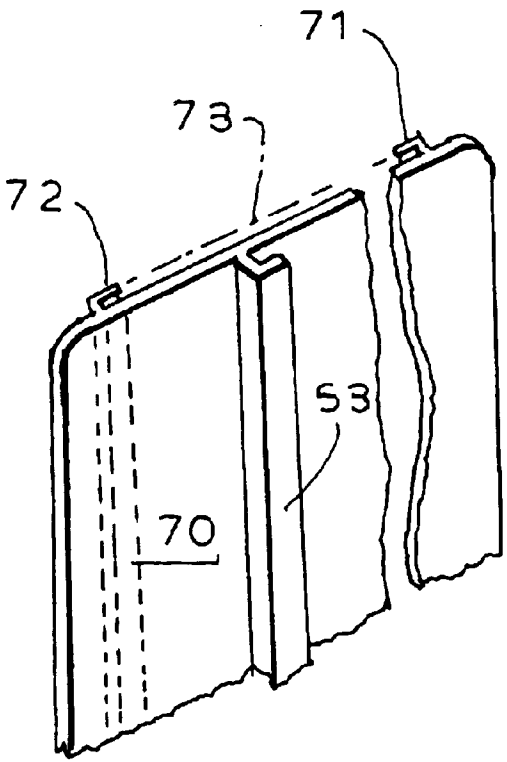

In the alternative form of the invention shown in FIG. 4, an extension panel 70, which is otherwise as previously described, is provided on its front surface with opposed, spaced-apart, vertically extending flanges 71, 72 forming opposed, vertically extending channels. A card 73 printed with advertising or other material may be removably inserted into the channels formed by the flanges 71, 72 to provide forwardly facing advertising or other information related to the product being displayed, store operations, or the like. The extension panel 70 otherwise can be of the same construction as the extension panel 50, for example, being provided with vertically extending flanges 52 (not shown) and 53 on the back surface thereof for mounting of the extension panel on a pusher 21. The printed cards may be discarded after use or saved, as desired.

In those cases where the pusher 21 is configured in the form of an inverted "Y", with a portion of the front panel extending above the level at which the back panel joins with the front panel, it may be desirable in certain instances to eliminate slots, such as 56 or 57, for receiving mounting flanges at the back of the extension panel. In such a case, the extension panel will come to a stop position at the level where the back panel joins with the front panel, giving the front panel somewhat of a T-shaped configuration.

The present invention greatly extends the usefulness and flexibility of product display racks having forwardly movable product pushers. Important advantages can be realized in connection with fixed-width display rack arrangements, but the advantages become even more pronounced in racks having a width adjustment capability, where the width of the basic pusher element must be proportioned to the minimum adjusted width of the display rack.

In connection with fixed-width display rack arrangements, for example, the extension panel can be used to advantage to provide for increasing the effective height of the pusher, enabling a given pusher to handle products of a variety of heights. Likewise, the invention enables a fixed-width display unit to be configured with replaceable advertising information, either extending above the displayed product and/or exposed when the last product item is removed.

Although the advantages of the invention may be realized to the greatest extent with a display rack constructed of wire in the manner specifically illustrated herein, the invention is also useful, and many of its important advantages are realized, with more conventionally constructed display racks with pusher features. Additionally, the invention is not limited to pusher display arrangements in which the pusher is actuated by spring means. Particularly in connection with certain relatively heavy product items, the spring force required to reliably move the displayed product forwardly may be such as to make it difficult for the display to be reloaded, and the spring forces required may be such as to introduce an element of injury risk. For displays of this type, the pusher element may be manually operated from the front of the display, as by means of a puller element operated from time-to-time by a store clerk. The important features of the present invention are fully realized in such a pull-type display system, as will be readily understood.

It thus will be understood that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A display rack assembly for the display of multiple product packages, with provisions for pushing product packages toward a front of the assembly as packages are removed, the assembly comprising (a) a support base, (b) a product pusher mounted on said support base for forward and rearward sliding movement, for urging packages to the front of said display assembly, (c) said product pusher comprising a front pusher panel (d) said front pusher panel having a first height and first width, and (e) a front wall extension panel having a second height and a second width, at least one of which is greater than the corresponding first height or first width, (f) said front wall extension panel being removably attachable to said front pusher panel to enlarge the effective front surface area of said product pusher to accommodate product package larger than said front pusher panel.

2. A display rack assembly according to claim 1, wherein (a) said product pusher comprising front and back panels, (b) a top edge portion of said back panel being joined with said front panel, and (c) bottom edge regions of said panels being spaced apart in the direction of said sliding movement.

3. A display rack assembly according to claim 2, wherein (a) the front and back pusher panels comprise a one-piece extrusion in which an upper edge of said back pusher panel is integrally joined with said front pusher panel, (b) said product pusher being of substantially uniform cross section from one side to the other.

4. A display rack assembly according to claim 3, wherein (a) said front wall extension panel is of extruded construction, of substantially uniform cross section from top to bottom.

5. A display rack assembly according to claim 4, wherein (a) said front wall extension panel is formed with laterally spaced apart mounting flanges on a back surface thereof forming inwardly opening channels on said back surface, (g) said inwardly opening channels engaging opposite side edge portions of said front pusher panel.

6. A display rack assembly according to claim 5, wherein (a) said product pusher is formed with edge slots in the region at which said back pusher panel joins with said front pusher panel, and (b) said mounting flanges are received in said edge slots.

7. A display rack assembly according to claim 6, wherein (a) said product pusher is extruded in a generally inverted V-shaped cross sectional configuration, comprising said front and back pusher panels and a bridging section joining upper edges of said panels, and (b) said edge slots are formed in said bridging section adjacent a back surface of said front pusher panel.

8. A display rack assembly according to claim 5, wherein (a) said front pusher panel is formed with an integral rib in a lower portion thereof, projecting forwardly from a front face of said panel, (b) said integral rib serving as a position stop for said expansion panel.

9. A display rack assembly according to claim 5, wherein (a) said front wall extension panel is of greater height than said front pusher panel.

10. A display rack assembly according to claim 5, wherein (a) said front wall extension panel is of greater width than said front pusher panel.

11. A display rack assembly according to claim 2, wherein (a) said support base comprises a plurality of spaced apart wire support elements extending in the back-to-front direction, and (b) said front and back pusher panels are formed in lower edge areas thereof with notches for slidably engaging said wire support elements.

12. A display rack assembly according to claim 1, wherein (a) said display rack assembly includes width-adjustable side guide elements mounted on opposite sides of said support base, for confining product packages on said display rack assembly.

(b) said pusher front panel having a width less than a minimum width adjustment of said side guide elements, and said extension panel having a width greater than said minimum width adjustment.

13. A display rack assembly according to claim 1, wherein (a) said display rack assembly is dimensioned for the display of particular predetermined product items having a predetermined height dimension, (b) said extension panel has an effective height greater than predetermined height dimension, whereby an upper margin of said extension panel projects above said height dimension, and (c) informational material is provided on said upper margin.

14. A display rack assembly according to claim 13, wherein (a) said extension panel is provided on a front surface portion thereof below said upper margin with additional informational material visible primarily when all product items have been removed from said display rack assembly.

15. A display rack assembly according to claim 14, wherein (a) said display rack assembly includes a plurality of extension panels, each intended for use with different products and each having informational material thereon relevant to the product with which it is intended to be used.

16. A display rack assembly according to claim 1, wherein (a) said product pusher includes a back panel having a top edge joined with said front panel and having a bottom edge spaced rearwardly of a bottom edge of said front panel, (b) said front wall extension panel having spaced apart vertically extending mounting flanges projecting from a back surface thereof and slidably engaging opposite side edges of said front panel.

17. A display rack assembly according to claim 16, wherein (a) said back panel is of equal width to said front panel, and (b) slots are formed in the opposite sides of said product pusher, in the region thereof in which said back panel top edge joins with said front panel, to accommodate the passage of said mounting flanges.

18. A display rack assembly according to claim 17, wherein said back panel joins said front panel at an upper edge of said front panel.

* * * * *